US006948305B2

(12) United States Patent
Beattie et al.

(10) Patent No.: US 6,948,305 B2
(45) Date of Patent: Sep. 27, 2005

(54) METHOD AND APPARATUS FOR BALANCING THE EMISSION CURRENT OF NEUTRALIZERS IN ION THRUSTER ARRAYS

(75) Inventors: John Robert Beattie, Westlake Village, CA (US); Prakash C. Soni, Hawthorne, CA (US)

(73) Assignee: The Boeing Company, Chicago, IL (US)

( * ) Notice: Subject to any disclaimer, the term of this patent is extended or adjusted under 35 U.S.C. 154(b) by 125 days.

(21) Appl. No.: 10/616,022

(22) Filed: Jul. 9, 2003

(65) Prior Publication Data

US 2005/0005593 A1 Jan. 13, 2005

(51) Int. Cl.[7] ..... H05H 1/00

(52) U.S. Cl. ..... 60/202; 313/359.1; 315/111.81

(58) Field of Search ..... 60/202, 203.1; 313/359.1–363.1; 315/111.81–111.91

(56) References Cited

U.S. PATENT DOCUMENTS

| | | | | |
|---|---|---|---|---|
| 4,733,530 A | | 3/1988 | Beattie et al. | |
| 5,269,131 A | * | 12/1993 | Brophy | 60/202 |
| 5,339,623 A | * | 8/1994 | Smith | 60/203.1 |
| 5,947,421 A | * | 9/1999 | Beattie et al. | 244/172 |
| 5,973,447 A | * | 10/1999 | Mahoney et al. | 313/359.1 |
| 6,031,334 A | * | 2/2000 | Meyer | 315/111.01 |
| 6,518,693 B1 | * | 2/2003 | Meyer et al. | 313/359.1 |
| 6,786,035 B2 | * | 9/2004 | Stickelmaier | 60/202 |

* cited by examiner

*Primary Examiner*—Ted Kim
(74) *Attorney, Agent, or Firm*—Gates & Cooper LLP

(57) ABSTRACT

An apparatus and method for balancing the emission current of neutralizers in ion thruster arrays is disclosed that allows a single power processing unit (PPU) to be used to drive the array. A typical embodiment includes at least one voltage-regulated power supply, each voltage-regulated power supply for driving a common element in each of the plurality of ion thrusters, the common element in each of the plurality of ion thrusters being coupled together at a common point, and a current balance circuit for providing a substantially balanced current to each neutralizer cathode of the plurality of ion thrusters by providing a voltage to the neutralizer cathodes relative to the common point.

23 Claims, 5 Drawing Sheets

METHOD AND APPARATUS FOR BALANCING THE EMISSION CURRENT OF NEUTRALIZERS IN ION THRUSTER ARRAYS

BACKGROUND OF THE INVENTION

1. Field of the Invention

The present invention relates to apparatuses and methods for optimizing the operation of ion thruster arrays. Particularly, the present invention relates to apparatuses and methods for balancing the emission current of neutralizers in ion thruster arrays.

2. Description of the Related Art

Ion propulsion generally involves employing an ionized gas accelerated electrically across charged grids to develop thrust. The electrically accelerated particles can achieve very high speeds. The gas used is typically a noble gas, such as xenon. The principle advantage afforded by ion propulsion systems over conventional chemical propulsion systems is their very high efficiency. For example, with the same amount of fuel mass an ion propulsion system can achieve a final velocity as much as ten times higher than that obtainable with a chemical propulsion system. Although the principle of ion propulsion was established many decades ago, it has only relatively recently been implemented in practical applications.

The delay in development of practical applications may be due, in part to the fact that, although they are efficient, ion propulsion systems develop very low thrust when compared with chemical propulsion systems. This reality has narrowed the range of ion propulsion applications. However, ion propulsion is well suited for space applications where low thrust is often acceptable and fuel efficiency is critical. More and more ion propulsion is becoming a component of new spacecraft designs. Many spacecraft, including satellites as well as exploration vehicles, are presently making use of ion propulsion systems.

For example, ion thrusters are currently used for spacecraft control on some communications satellites. In a typical satellite ion thruster, thrust is created by accelerating positive ions through a series of gridded electrodes at one end of a thrust chamber. The electrodes, known as an ion extraction assembly, create thousands of tiny beams of thrust. The beams are prevented from being electrically attracted back to the thruster by an external electron-emitting neutralizer. The power processing unit (PPU) is the device which serves to provide electrical control and power to drive the ion thruster, including control of the emission current in the neutralizer cathode.

FIG. 1 is a schematic diagram of a power processor system 100 operating with two individual power processor units 102A, 102B (collectively referred to as 102), one for each ion thruster 104A, 104B (collectively referred to as 104) of a thruster pair. The ion thrusters 104 each include a thruster body 106A, 106B (collectively referred to as 106) and a neutralizer body 108A, 108B (collectively referred to as 108) which are each electrically driven by their respective PPU 102A, 102B.

The principle elements of a PPU 102A, 102B include the discharge power supply 110A, 110B (collectively referred to as 110) coupled to the anode of the thruster body 106A, 106B to provide ionizing power to the fuel (e.g., Xenon) and the screen power supply 112A, 112B (collectively referred to as 112) coupled to the discharge cathode of the thruster body 106A, 106B to drive the main beam. In addition, the PPU 102A, 102B includes a discharge heater supply 114A, 114B (collectively referred to as 114) coupled to the discharge cathode heater to heat it to a high temperature at startup and initiate electron emission for gas ionization and a keeper supply 116A, 116B (collectively referred to as 116) coupled to the discharge keeper to maintain electron emission for ionization after startup. The accelerator supply 118A, 118B (collectively referred to as 118) accelerates ions out of the thruster body 106A, 106B.

The PPU 102A, 102B also includes similar power supplies to drive the neutralizer 108A, 108B which serves to both charge neutralize and current neutralize the ion beam. The neutralizer heater supply 120A, 120B (collectively referred to as 120), coupled to the neutralizer cathode heater, heats it to initiate electron emission from the neutralizer. The neutralizer keeper supply 122A, 122B (collectively referred to as 122) maintains electron emission after startup. The Zener diodes 124A, 124B (collectively referred to as 124) allow the respective neutralizer cathodes to float at whatever potential is necessary to supply the correct electron emission to neutralize the positive ion beam of thrusters 104.

One critical element of an ion thruster is the neutralizer cathode. The neutralizer cathode, commonly a hollow cathode, is generally life limited by its operating temperature; the higher the operating temperature, the shorter the operating life of the cathode (and accordingly, the shorter the operating life of the thruster). Because the operating temperatures of such cathodes are directly proportional to their emission current, control of the emission current in the neutralizer cathode is important to maximizing the thruster's operating life. Consequently, in order to maximize operating life, a single PPU is provided to drive each ion thruster due to sensitivities such as the cathode emission current. Thus, a typical satellite using four ion thrusters (two pairs) requires four separate PPUs so that all four thrusters are capable of being turned on simultaneously. Consequently, this adds considerably to the mass required to drive the ion thruster array.

There is a need in the art for power processor systems for ion thruster arrays which are robust with optimized life. Further, there is a need for such systems to have reduced mass. As detailed hereafter, the present invention meets these and other needs.

SUMMARY OF THE INVENTION

In general, the prior art requires a dedicated PPU to power each individual thruster. The present invention allows a single PPU to power a plurality of ion thrusters in an array with the voltage-regulated supplies common to certain elements of the ion thrusters. (The current-regulated supplies have individual outputs so as to provide desired controlled currents to the anodes, keepers and heaters.) The advantage of this approach is mass savings in the voltage-regulated supplies and a significant reduction in the overall packaging mass.

The present invention achieves the desired current balance using a simple electronic circuit and bias power supply, eliminating the complexity of prior art gas control systems used with ion thrusters. As a result, a significant improvement in ion propulsion system design, reducing the complexity, expense and system mass, can be realized because two or more thrusters can operate from a properly designed single PPU. The current art would require two PPUs, as shown in FIG. 1.

With the present invention,construction of the PPU for an array of ion thrusters begins by distinguishing the voltage-regulated power supplies from the current-regulated power supplies within a typical PPU. The voltage-regulated power supplies can be combined into a single power supply to drive a common element in each of the plurality of ion thrusters of the array. For example, the screen power supply and the accelerator power supply are voltage-regulated power supplies in a typical PPU. The common elements in each of the plurality of ion thrusters are coupled together at a common point. A current balance circuit can provide a substantially balanced current to each neutralizer cathode of the plurality of ion thrusters by providing a voltage to the neutralizer cathodes relative to the common point. Significant cost and mass savings can be realized through the use of common voltage-regulated power supplies. Employing the current balance circuit to balance currents between the neutralizer cathodes in the array makes common voltage-regulated power supplies possible while avoiding the problems of prior art systems discussed hereafter.

It should also be noted that some elements of the ion thrusters require current-regulated power supplies to properly regulate the current supplied. For example, the discharge power supplies, as well as the heater and keeper power supplies for both the thruster body and the neutralizer are current-regulated power supplies in a typical PPU. These current-regulated power supplies can also be included in an integrated PPU, separately driving each thruster in the array.

BRIEF DESCRIPTION OF THE DRAWINGS

Referring now to the drawings in which like reference numbers represent corresponding parts throughout.

DETAILED DESCRIPTION OF THE PREFERRED EMBODIMENT

Figure 1:
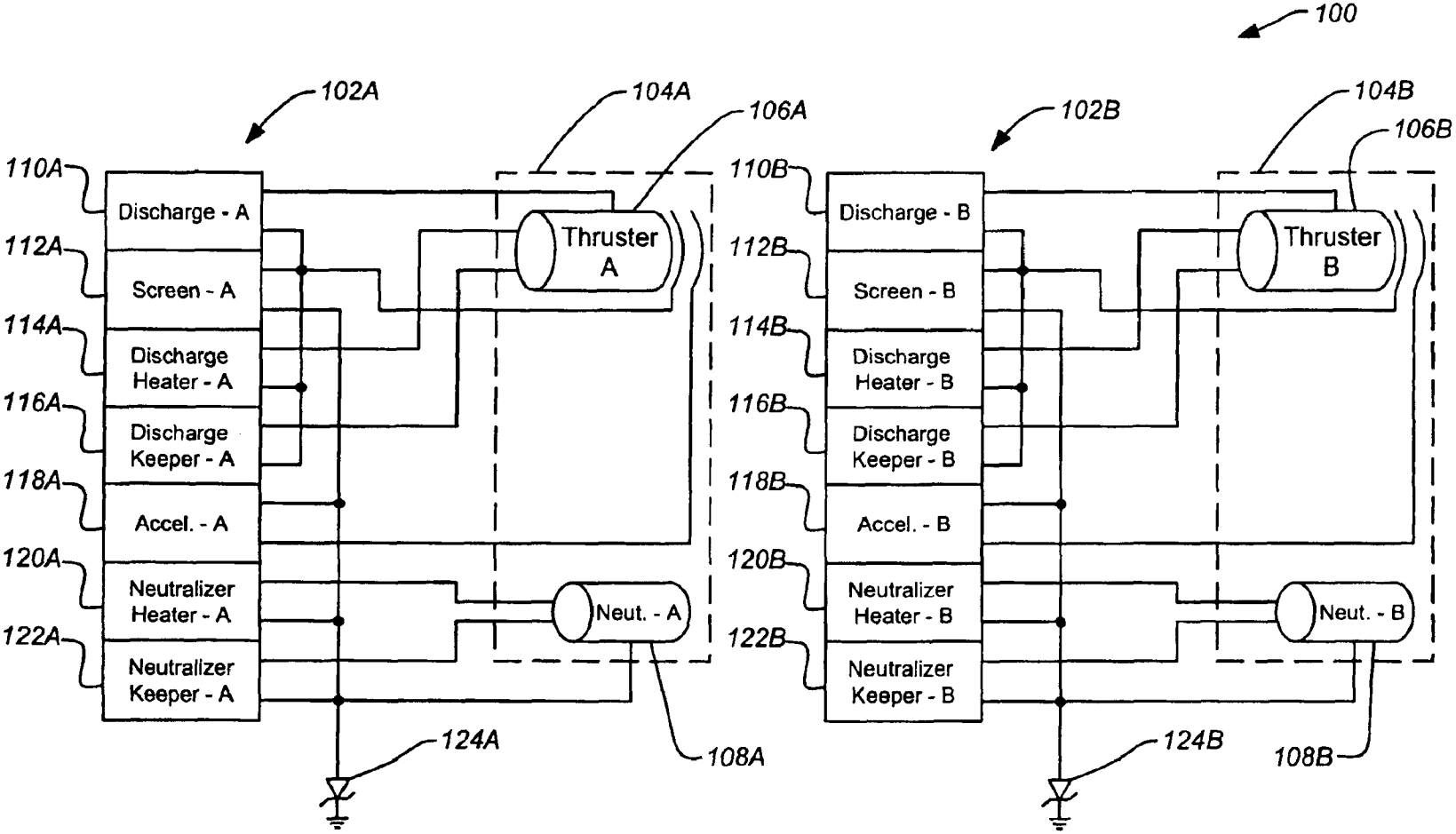
FIG. 1 Prior Art
FIG. 1 is a schematic diagram of a conventional power processor system operating with individual power processor units for each thruster.

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

1. Overview

Because it is important to minimize the operating temperature of the neutralizer cathodes, as discussed above, it is not reasonable to simply combine all the PPUs in a single device with common power supplies to each ion thruster component of a plurality of ion thrusters in an array. In such a thruster array, the common return to the PPU from the neutralizer cathodes of the ion thrusters would be electrically connected to each other. As a result, the total electron emission would not be balanced equally between the neutralizer cathodes. Consequently, the operating temperatures of the neutralizer cathodes would be unequal. Therefore, if the emission current of one neutralizer cathode greatly exceeds that of another neutralizer cathode, then the neutralizer cathode with the higher emission must operate at a higher temperature. With the thruster life limited by neutralizer cathode temperature, the neutralizer cathode providing the majority of the emission and operating at an increased temperature will have a shorter life than it would if the emission current were balanced between the ion thrusters of the array. However, the thruster array would fail as soon as one of the thrusters fails. Moreover, since the relationship between thruster life and cathode temperature is highly nonlinear, the life of an ion thruster array with neutralizer cathodes that experience unequal current sharing may be dramatically lower than that which could be realized with equal current sharing.

Previously, in order to balance emission current between two or more cathodes in an ion propulsion system, the flow of gas has been varied through the individual cathodes in direct proportion to their emission current. Such a technique is described in U.S. Pat. No. 4,733,530 issued Mar. 29, 1988 to Beattie et al., which is incorporated by reference herein. For example, the neutralizer cathodes in the ETS-6 satellite (as described in Shimada et al., "Evaluation of Ion Thruster Beam Neutralization," AIDAA/AIAA/DGLR/JSASS Paper IEPC 91-025, October 1991, which is incorporated by reference herein) are connected in common. However in this case, a gas control system is used to maintain equal current sharing between the two cathodes. Dedicated PPUs are used to power each thruster, however, the neutralizer cathodes are connected directly to the screen supply return through individual current sensors. In order to achieve equal current sharing, the flow of propellant through the cathodes is adjusted in proportion to their sensed emission currents. This flow control scheme is very complicated, requiring a plenum chamber and flow control valves to achieve flow variability. In contrast, the present invention achieves the desired current balance using a simple electronic circuit and bias power supply, eliminating the complexity of the previous gas control system.

Importantly, embodiments of the invention include a current balance circuit to balance the emission currents to the neutralizer cathodes. Without such a regulator, there is no way to be certain that the neutralizer emission current is equally balanced between the two neutralizer cathodes. A significant imbalance in neutralizer emission could result in overheating of the cathode supplying the bulk of the emission, leading to a reduction in the life of the ion thruster array. However, the present invention eliminates the current imbalance by forcing the voltage of one cathode to change relative to the voltage of the other cathode (voltages referenced to a common point, e.g. the screen supply return) in order to achieve equal current in each cathode.

Embodiments of the invention can be applied to existing ion thruster designs, e.g. 13 cm and 25 cm xenon ion propulsion systems (XIPS). In addition to hardware savings, embodiments of the invention can yield significant weight reduction which corresponds to considerable savings in launch costs per spacecraft.

2. Exemplary Embodiments of the Invention

Figure 2:
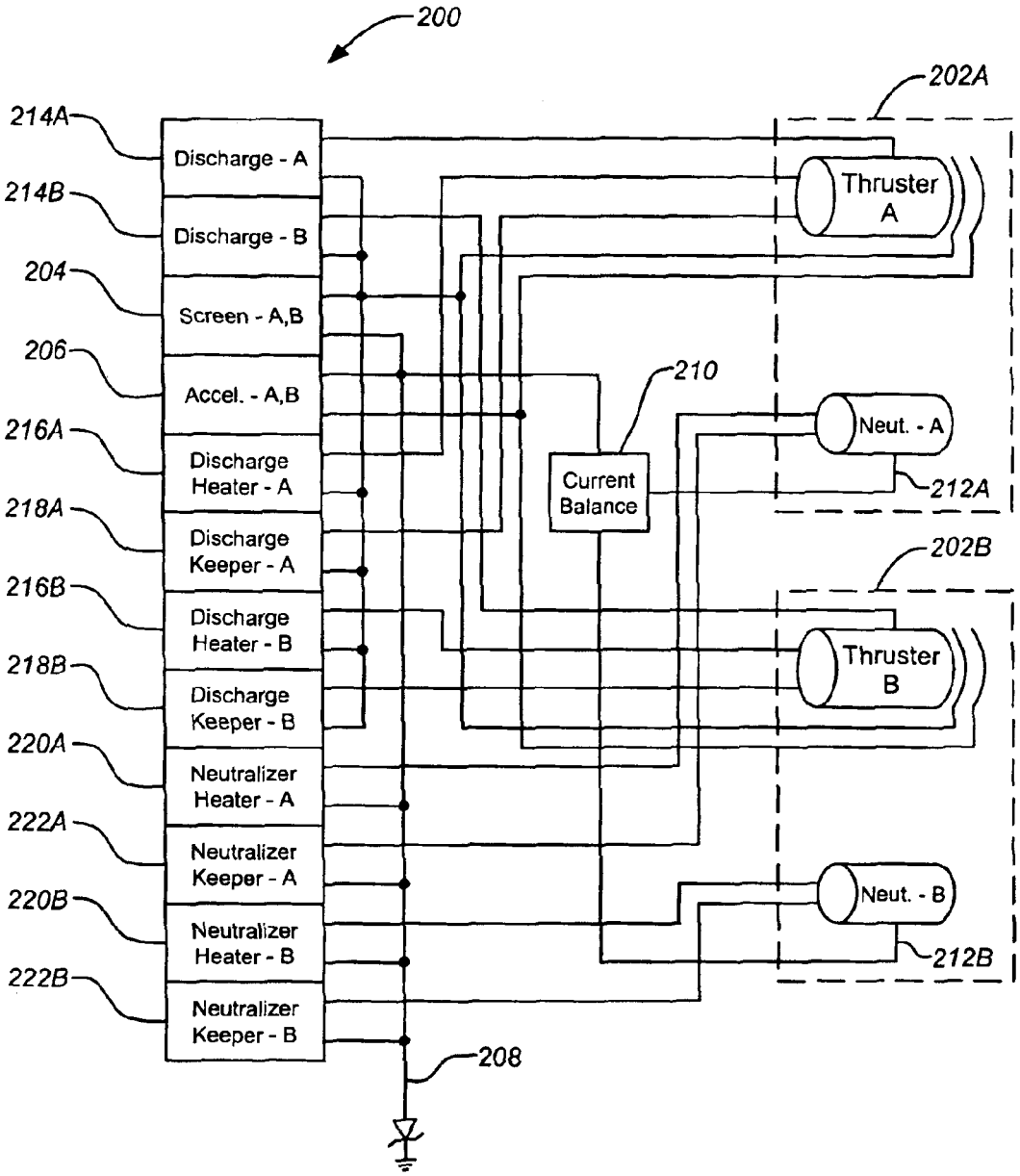
FIG. 2 illustrates an exemplary embodiment of the present invention where a single power processor unit operates for a plurality of thrusters.

FIG. 2 illustrates an exemplary embodiment of the present invention where a single power processor unit 200 operates to drive a plurality of ion thrusters 202 (individually referenced as 202A and 202B). The ion thrusters 202 operate as previously described with reference to FIG. 1. The invention reduces the number of individual power supplies in the PPU and, therefore, is less costly to manufacture and saves mass on orbit. The PPU includes one or more voltage-regulated power supplies for driving a common element in each of the ion thrusters 202.

In this example, the voltage-regulated power supplies are the screen power supply 204 for driving each screen of the ion thrusters 202 and an accelerator power supply 206 for driving each accelerator grid of the plurality of ion thrusters. The common elements (screens and accelerator grids) in each of the ion thrusters 202 are coupled together through their respective power supplies at a common point 208. A current balance circuit 210 is used to provide substantially balanced current to each neutralizer cathode 212A, 212B (collectively referenced as 212) of the of ion thrusters 202 by providing a voltage to the neutralizer cathodes 212 relative to the common point 208.

The PPU 200 can also include a plurality of current-regulated power supplies each for driving a separate element in each of the plurality of ion thrusters. In the example, the current-regulated power supplies include discharge power supplies 214A, 214B (collectively referenced as 214), each for driving discharge plasma in a discharge chamber (the separate element) in a separate ion thruster 202 of the array of ion thrusters. Similarly, the exemplary PPU 200 can also include: discharge heater power supplies 216A, 216B (collectively referenced as 216), each for driving a discharge cathode heater in a separate ion thruster 202; discharge keeper power supplies 218A, 218B (collectively referenced as 218), each for maintaining electron discharge in a separate ion thruster 202; neutralizer heater power supplies 220A, 220B (collectively referenced as 220), each for driving a neutralizer cathode heater in a separate ion thruster 202; and neutralizer keeper power supplies 222A, 222B (collectively referenced as 222), each for maintaining electron discharge in a neutralizer of a separate ion thruster 202.

Figure 3A:
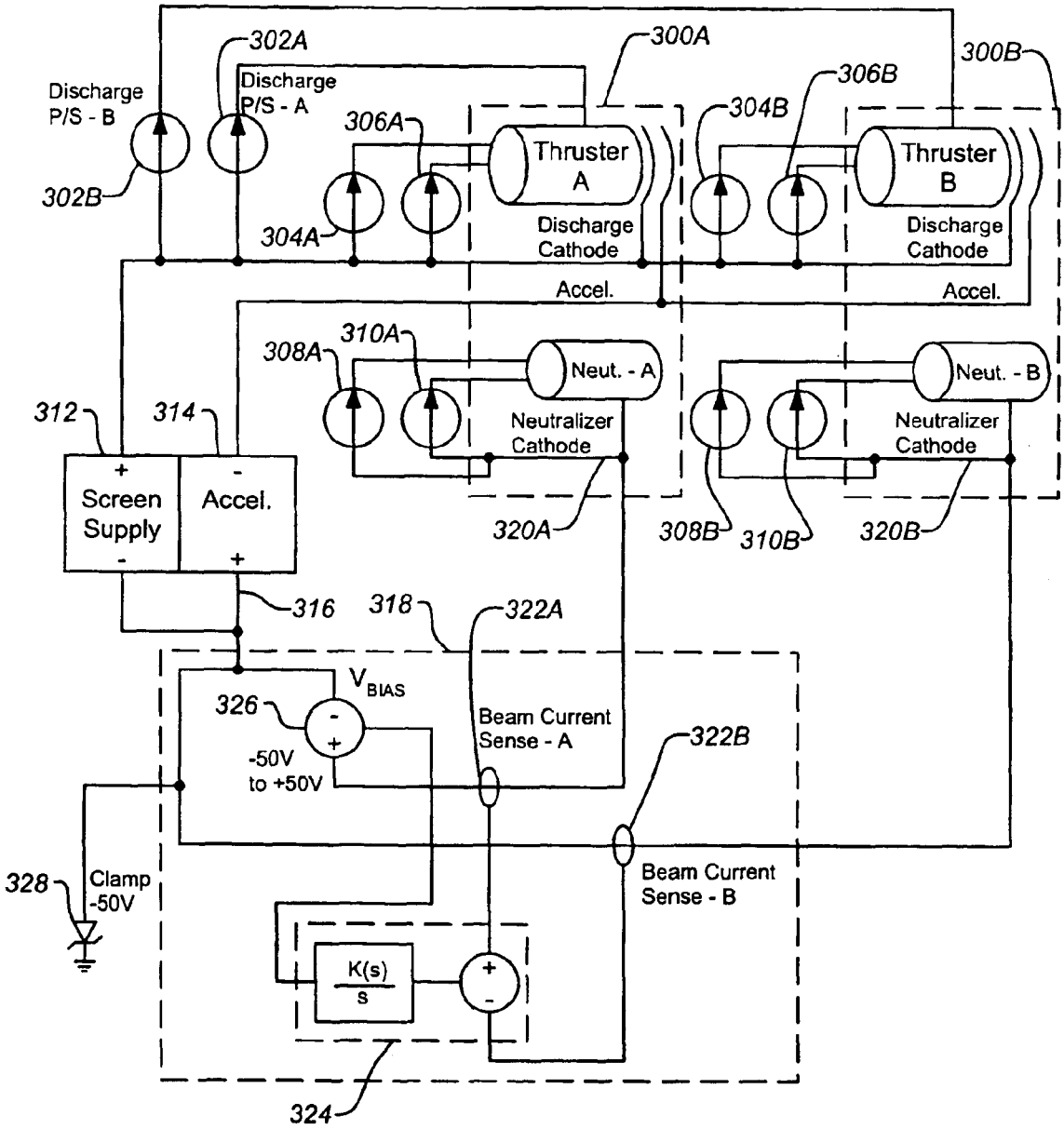
FIG. 3A illustrates an exemplary embodiment of a neutralizer emission balance scheme using a single bias power supply.

FIG. 3A illustrates an exemplary embodiment of a neutralizer emission balance scheme using a single bias power supply. The two ion thrusters 300A, 300B (collectively referenced as 300) are driven by a plurality of power supplies which can be combined in a PPU as described above. The current-regulated power supplies separately drive particular elements of each thruster 300A, 300B (as described in relation to FIG. 1) and include discharge power supplies 302A, 302B (collectively referenced as 302), discharge heater power supplies 304A, 304B (collectively referenced as 304), discharge keeper power supplies 306A, 306B (collectively referenced as 306), neutralizer heater power supplies 308A, 308B (collectively referenced as 308) and neutralizer keeper power supplies 310A, 310B (collectively referenced as 310). The voltage-regulated power supplies include the screen power supply 312 and the accelerator power supply 314. These voltage-regulated power supplies 312, 314 drive common elements in each of the ion thrusters 300. In addition, these power supplies 312, 314 are electrically coupled at a common point 316.

From the foregoing description it can be seen that the invention eliminates ion propulsion hardware by simplifying the PPU arrangement. However, in order to successfully implement the improved design it is necessary to ensure that the electron emission current provided by each neutralizer cathode is equally balanced. This can be accomplished using the electronic current balance circuit detailed below.

The current balance circuit 318 of this embodiment operates to provide a voltage difference between the two neutralizer cathodes 320A, 320B (collectively referenced as 320) of the two ion thrusters 300. In this example one of the cathodes 320B is coupled directly to the common reference point 316 with the voltage-regulated power supplies 312, 314. The neutralizer cathode 320B is coupled to ground through a Zener diode 328 to allow it to float at a potential necessary to supply the correct electron emission to neutralize the positive ion beam of thrusters 300.

Current sensors 322A, 322B (collectively referenced as 322) are coupled to the neutralizer cathodes 320. The sensed currents are provided to an error amplifier 324 which provides a control signal output based on a comparison between the sensed currents. As is known in the art, an appropriate gain can be applied to the signal processed by the error amplifier 324. The output signal from the error amplifier 324 is then coupled to a bias power supply 326 which provides a voltage difference to the first neutralizer cathode 320A relative to the second neutralizer cathode 320B based upon the current comparison. Thus, a substantially balanced current to the first and second neutralizer cathodes 320A, 320B is maintained.

The neutralizer cathode 320A of the first thruster 300A is connected to the neutralizer cathode 320B of the second thruster 300B through the bias power supply 326. The bias supply 326 can provide an output voltage of either polarity, driving the potential of neutralizer cathode 320A either positive or negative with respect to the potential of neutralizer cathode 320B. Typically, the voltage difference provided by the bias power supply 326 is in a range from +50V to −50V. In comparing the currents, the error amplifier 324 (which includes a control circuit for the bias supply 326) monitors the emission current of each cathode 320A, 320B and sums them to derive the total emission $J_T=J_A+J_B$. Then the bias voltage $V_{bias}$ is adjusted by the error amplifier 324 to a value that satisfies the relationship $J_A=J_B=J_T/2$. As an alternate technique, $J_A$ and $J_B$ can be compared directly with each other in the error amplifier 324 and $V_{bias}$ is adjusted in a way that satisfies the relationship $J_A=J_B$.

Figure 3B:
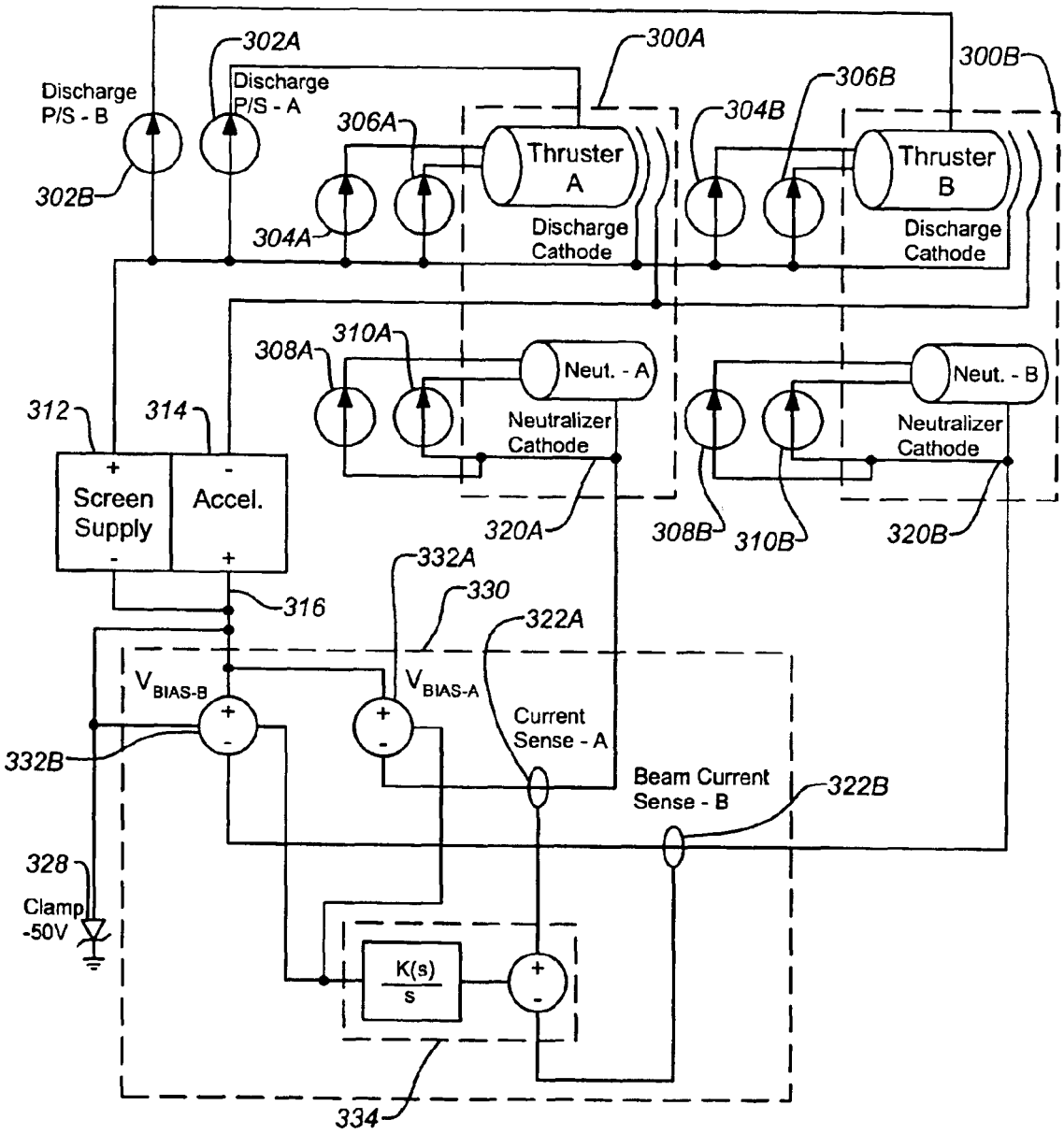
FIG. 3B illustrates an exemplary embodiment of a neutralizer emission balance scheme using individual bias power supplies.

FIG. 3B illustrates an exemplary embodiment of a neutralizer emission balance scheme using individual bias power supplies. The common voltage-regulated power supplies 312, 314 and the individual current-regulated power supplies 302–310 operate to drive the ion thruster 300 as described above in FIG. 3A.

In this embodiment, the current balance circuit 330 comprises individual bias power supplies 332 (individually referenced as 332A, 332B), one for each ion thruster 300A, 300B, that are used to maintain a substantially equal current among the neutralizer cathodes 320. The current sensors 322A, 322B sense separate currents of each neutralizer cathode 320A, 320B of each ion thruster 300A, 300B. The error amplifier 334 (including a control circuit to drive the bias power supplies 332) compares the currents of each neutralizer cathode 320A, 320B and provides a control signal output coupled to each bias power supply 332A, 332B. Depending upon the signal polarity from the error amplifier 334, one of the bias power supplies 332A or 332B provides a voltage difference between it's neutralizer cathode and the common point 316 to produce a substantially balanced current among each of the neutralizer cathodes. For example, if the current from current sensor 322A is higher than that from current sensor 322B, the error amplifier 324 will generate a positive signal and bias power supply 332B will generate a voltage proportional to the error signal, causing a reduction to the current in cathode 320A (and sensor 322A) and an increase in the current in cathode 320B (and sensor 322B). Thus, the cathode currents will equalize by action of the control loop. Similarly, if the current from sensor 322B is higher than the current from current sensor 322A, the error amplifier will produce a negative signal and bias power supply 332A will generate a voltage proportional to the error signal to cause a reduction in the current to cathode 320B and an increase in cathode 320A. Typically, the voltage difference is in a range from 0V to +50V.

The neutralizer cathode 320A, 320B currents $J_A$ and $J_B$ are sensed and compared to the average current $(J_A+J_B)/2$. The bias voltages $(V_{bias})_A$ and $(V_{bias})_B$ are adjusted to null the respective error signals $J_A-(J_A+J_B)/2$ and $J_B-(J_A+J_B)/2$. Here also as an alternate technique, $J_A$ and $J_B$ can be compared directly with the control circuit adjusting $(V_{bias})_A$ and $(V_{bias})_B$ so that $J_A$ becomes equal to $J_B$.

2. Exemplary Methods of the Invention

Figure 4:
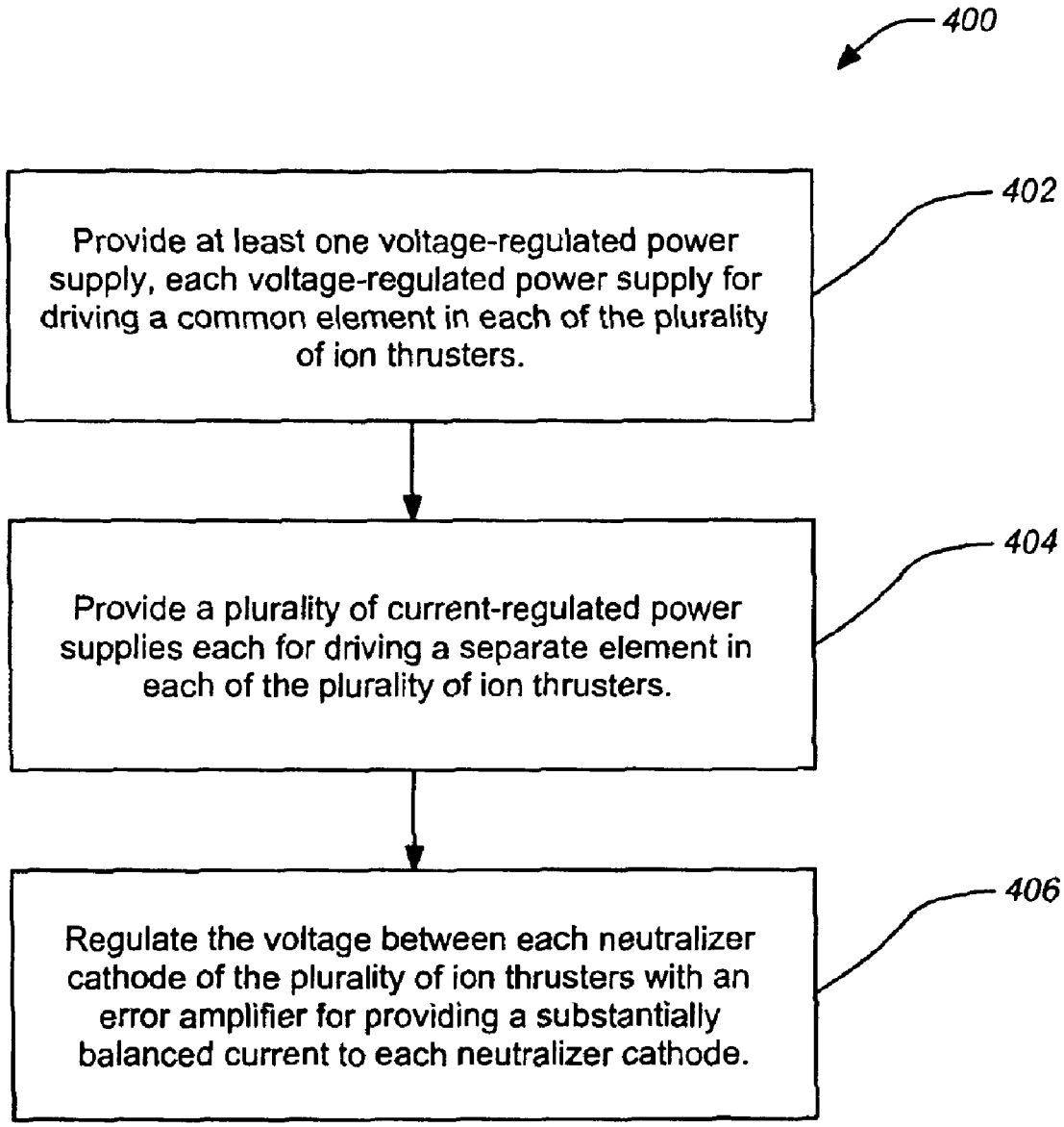
FIG. 4 is a flowchart of a neutralizer emission balance method of the invention.

FIG. 4 is a flowchart of a neutralizer emission balance method 400 of the invention. The method 400 begins at step 402 by providing at least one voltage-regulated power supply, each voltage-regulated power supply for driving a common element in each of the plurality of ion thrusters. Next, at step 404, a plurality of current-regulated power supplies are provided, each for driving a separate element in each of the plurality of ion thrusters. Finally, at step 406, the voltage between each neutralizer cathode of the plurality of ion thrusters is regulated with an electronic current balance circuit for providing a substantially balanced current to each neutralizer cathode. The voltage-regulated power supply can comprise a screen power supply for driving each screen of the plurality of ion thrusters and/or an accelerator power supply for driving each accelerator grid of the plurality of ion thrusters.

In further embodiments, a plurality of current-regulated power supplies can be provided each for driving a separate element in each of the plurality of ion thrusters. The plurality of current-regulated power supplies can include: discharge power supplies, each for driving a discharge chamber in a separate ion thruster of the plurality of ion thrusters; discharge heater power supplies, each for driving a discharge heater in a separate ion thruster of the plurality of ion thrusters; discharge keeper power supplies, each for maintaining electron discharge in a separate ion thruster of the plurality of ion thrusters; neutralizer heater power supplies, each for driving a neutralizer heater in a separate ion thruster of the plurality of ion thrusters; and neutralizer keeper power supplies, each for maintaining current in a neutralizer of a separate ion thruster of the plurality of ion thrusters.

In one embodiment, the PPU drives two ion thrusters. Voltage between the neutralizer cathodes is regulated in the following manner. First, currents of the first neutralizer cathode and second neutralizer cathodes of the two ion thrusters are sensed. Then, the sensed currents are compared using an error amplifier to provide an output signal based on the comparison (with a gain optionally applied). Finally, a voltage difference to the first neutralizer cathode relative to the second neutralizer cathode based upon the current comparison is provided with a bias power supply. The voltage difference produces a substantially balanced current to the first and second neutralizer cathodes in a closed loop manner. In a typical example, the voltage difference can be in a range from +50V to −50V.

In addition, in the two ion thruster PPU, the common cathode connection can be coupled to ground through a Zener diode to allow the common cathode to float at a potential necessary to supply the correct electron emission to neutralize the positive ion beams of the thrusters.

In a general embodiment, applicable to driving two or more ion thrusters, voltage between the neutralizer cathodes can be regulated in the following manner. As above, a current is first sensed for each neutralizer cathode of each ion thruster of the plurality of ion thrusters. Then, a comparator is used to provide a current comparison between the sensed currents of each neutralizer cathode. Finally, a bias power supply for each neutralizer cathode is coupled to the comparator and control circuit to provide a voltage difference between each neutralizer cathode and a common reference point based on the current comparison. The applied voltage differences result in a substantially balanced current to each of the neutralizer cathodes. The voltage difference can typically range from 0V to +50V.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The above specification, examples and data provide a complete description of the manufacture and use of the apparatus and method of the invention. Since many embodiments of the invention can be made without departing from the scope of the invention, the invention resides in the claims hereinafter appended.

What is claimed is:

1. An apparatus for driving a plurality of ion thrusters including at least a first ion thruster and a second ion thruster, comprising:

at least one voltage-regulated power supply, each voltage-regulated power supply for driving a common element in each of the plurality of ion thrusters, the common element in each of the plurality of ion thrusters being coupled together at a common point;

a current sensor of a first neutralizer cathode of the first ion thruster providing a first sensed current;

a second current sensor of a second neutralizer cathode of the second ion thruster providing a second sensed current;

a control circuit for providing a current comparison between the first and second sensed currents; and a current balance circuit including a bias power supply coupled to the control circuit, the current balance circuit for providing a substantially balanced current to each neutralizer cathode of the plurality of ion thrusters, and the bias power supply providing a voltage difference to the first neutralizer cathode relative to the second neutralizer cathode based upon the current comparison relative to the common point.

2. The apparatus of claim 1, wherein the at least one voltage-regulated power supply comprises:

a screen power supply for driving each screen of the plurality of ion thrusters; and an accelerator power supply for driving each accelerator grid of the plurality of ion thrusters.

3. The apparatus of claim 1, further comprising a plurality of current-regulated power supplies each for driving a separate element in each of the plurality of ion thrusters.

4. The apparatus of claim 3, wherein the plurality of current-regulated power supplies comprises:

a plurality of discharge power supplies, each for driving discharged electrons in a separate ion thruster of the plurality of ion thrusters;

a plurality of discharge heater power supplies, each for driving a discharge heater in a separate ion thruster of the plurality of ion thrusters;

a plurality of discharge keeper power supplies, each for maintaining electron discharge in a separate ion thruster of the plurality of ion thrusters;

a plurality of neutralizer heater power supplies, each for driving a neutralizer heater in a separate ion thruster of the plurality of ion thrusters;

a plurality of neutralizer keeper power supplies, each for maintaining current in a neutralizer of a separate ion thruster of the plurality of ion thrusters.

5. The apparatus of claim 1, wherein the control circuit determines a sum of the first and second sensed current and provides current comparison so that the first and second current both equal substantially half of the sum.

6. The apparatus of claim 1, wherein the control circuit provides the current comparison so that the first current and the second current are substantially equal.

7. The apparatus of claim 1, wherein the voltage difference is in a range from +50V to −50V.

8. The apparatus of claim 1, wherein the second neutralizer cathode is coupled to ground through a Zener diode so allow the second neutralizer cathode to float at a potential necessary to supply the correct electron emission to neutralize the positive ion beam of thruster.

9. The apparatus of claim 1, where the current balance circuit comprises:

a plurality of current sensors sensing separate currents to each neutralizer cathode of each ion thruster of the plurality of ion thrusters;

a control circuit for a providing a current comparison between the sensed currents to each neutralizer cathode of each ion thruster of the plurality of ion thrusters;

a bias power supply for each neutralizer cathode coupled to the control circuit to provide a voltage difference between each neutralizer cathode and the common point based on the current comparison to produce a substantially balanced current to each of the neutralizer cathodes.

10. The apparatus of claim 9, wherein the control circuit determines a sum of the separate currents and provides current comparison so that the separate currents equal substantially half of the sum.

11. The apparatus of claim 9, wherein the control circuit provides the current comparison so that the separate current are substantially equal.

12. The apparatus of claim 9, wherein the voltage difference is in a range from 0V to 50V.

13. A method of driving a plurality of ion thrusters including at least a first ion thruster and a second ion thruster, comprising the steps of:

providing at least one voltage-regulated power supply, each voltage-regulated power supply for driving a common element in each of the plurality of ion thrusters;

providing a plurality of current-regulated power supplies each for driving a separate element in each of the plurality of ion thrusters;

sensing a first current of a first neutralizer cathode of the first ion thruster with a first current sensor;

sensing a second current of a second neutralizer cathode of the second ion thruster with a second current sensor;

comparing the first and second sensed currents with a control circuit to providing a current comparison between the first and second sensed currents;

providing a voltage difference to the first neutralizer cathode relative to the second neutralizer cathode based upon the current comparison; and regulating the voltage difference between each neutralizer cathode of the plurality of ion thrusters with a current balance circuit for providing a substantially balanced current to each neutralizer cathode, wherein the voltage difference is provided with a bias power supply coupled to the control circuit, the control circuit determining a sum of the first and second sensed currents and providing the current comparison so that the first and second currents both equal substantially half of the sum.

14. The method of claim 13, wherein the at least one voltage-regulated power supply comprises:

a screen power supply for driving each screen of the plurality of ion thrusters; and an accelerator power supply for driving each accelerator grid of the plurality of ion thrusters.

15. The method of claim 13, further comprising providing a plurality of current-regulated power supplies each for driving a separate element in each of the plurality of ion thrusters.

16. The method of claim 15, wherein the plurality of current-regulated power supplies comprises:

a plurality of discharge power supplies, each for driving discharged electrons in a separate ion thruster of the plurality of ion thrusters a plurality of discharge heater power supplies, each for driving a discharge heater in a separate ion thruster of the plurality of ion thrusters;

a plurality of discharge keeper power supplies, each for maintaining electron discharge in a separate ion thruster of the plurality of ion thrusters;

a plurality of neutralizer heater power supplies, each for driving a neutralizer heater in a separate ion thruster of the plurality of ion thrusters;

a plurality of neutralizer keeper power supplies, each for maintaining current in a neutralizer of a separate ion thruster of the plurality of ion thrusters.

17. The method of claim 13, wherein the control circuit provides the current comparison so that the first current and the second current are substantially equal.

18. The method of claim 13, wherein the voltage difference is in a range from +50V to −50V.

19. The method of claim 13, wherein the second neutralizer cathode is coupled to ground through a Zener diode to allow the second neutralizer cathode to float at a potential necessary to supply the correct electron emission to neutralize the positive ion beam of thrusters.

20. The method of claim 13, where the current balance circuit comprises the steps of:

a plurality of current sensors sensing separate currents to each neutralizer cathode of each ion thruster of the plurality of ion thrusters;

a control circuit for a providing a current comparison between the sensed currents to each neutralizer cathode of each ion thruster of the plurality of ion thrusters;

a bias power supply for each neutralizer cathode coupled to the control circuit to provide a voltage difference between each neutralizer cathode and the common point based on the current comparison to produce a substantially balanced current to each of the neutralizer cathodes.

21. The method of claim 20, wherein the control circuit determines a sum of the separate currents and provides current comparison so that the separate currents equal substantially half of the sum.

22. The method of claim 20, wherein the control circuit provides the current comparison so that the separate currents are substantially equal.

23. The method of claim 20, wherein the voltage difference is in a range from 0V to 50V.

* * * * *